US010049797B2

(12) United States Patent
Zhu et al.

(10) Patent No.: US 10,049,797 B2
(45) Date of Patent: Aug. 14, 2018

(54) LOW-NEODYMIUM, NON-HEAVY-RARE-EARTH AND HIGH PERFORMANCE MAGNET

(71) Applicant: Central Iron and Steel Research Institute, Beijing (CN)

(72) Inventors: Minggang Zhu, Beijing (CN); Jingdai Wang, Beijing (CN); Wei Li, Beijing (CN); Haibo Feng, Beijing (CN); Yikun Fang, Beijing (CN); Yanfeng Li, Beijing (CN); Mingge Zhou, Beijing (CN); Xuchao Wang, Beijing (CN); Shulin Huang, Beijing (CN)

(73) Assignee: CENTRAL IRON AND STEEL RESEARCH INSTITUTE, Beijing (CN)

( * ) Notice: Subject to any disclaimer, the term of this patent is extended or adjusted under 35 U.S.C. 154(b) by 737 days.

(21) Appl. No.: 13/711,642

(22) Filed: Dec. 12, 2012

(65) Prior Publication Data

US 2013/0154778 A1 Jun. 20, 2013

(30) Foreign Application Priority Data

Dec. 15, 2011 (CN) ..... 2011 1 0421875

(51) Int. Cl.
*H01F 1/01* (2006.01)
*H01F 41/02* (2006.01)
*H01F 1/057* (2006.01)

(52) U.S. Cl.
CPC ..... *H01F 1/015* (2013.01); *H01F 1/0573* (2013.01); *H01F 41/0266* (2013.01); *H01F 41/0273* (2013.01)

(58) Field of Classification Search
CPC ..... H01F 1/015; H01F 41/0266
USPC ..... 148/105
See application file for complete search history.

(56) References Cited

U.S. PATENT DOCUMENTS 6,261,387 B1 * 7/2001 Panchanathan ..... H01F 1/0578 148/302
2005/0268989 A1 * 12/2005 Tomizawa ..... H01F 41/0266 148/105

OTHER PUBLICATIONS

Fan, X., et al., "Tuning Ce Distribution for High Performanced Nd—Ce—Fe—B Sintered Magnets," Journal of Magnetism & Magnetic Materials 419:394-399 (2016).
Jin, J., et al., "Chemically Inhomogeneous Re—Fe—B Permanent Magnets with High Figure of Merit: Solution to Global Rare Earth Criticality," Scientific Reports 6:32200; doi: 10.1038/srep32200 (2016).
Zhang, Y., et al., "Effects of REFe2 on Microstructure and Magnetic Properties of Nd—Ce—Fe—B Sintered Magnets," Acta Materialia 128:22-30 (2017).
Zhu, M., et al., "An Enhanced Coercivity for (CeNdPr)—Fe—B Sintered Magnet Prepared by Structure Design," IEEE Transactions on Magnetics 51(11):2104604 (2015).

* cited by examiner

*Primary Examiner* — Edward M Johnson
(74) *Attorney, Agent, or Firm* — Perkins Coie LLP

(57) ABSTRACT

The invention discloses a low-neodymium, non-heavy-rare-earth and high-performance magnet and its preparing method, and belongs to technical field of rare earth permanent magnetic material. The magnet has a chemical formula of $[(Nd, Pr)_{100-x}(Ce_{100-y}La_y)_x]_aFe_{100-a-b-c}B_bTM_c$, wherein x, y, a, b and c represent mass percents of corresponding elements respectively, $0 \le x \le 40\%$, $0 \le y \le 15\%$, $29 \le a \le 30\%$, $0.5 \le b \le 5\%$, $0.5 \le c \le 5\%$; and TM is one or more selected from Ga, Co, Cu, Nb and Al elements. A series of grades of magnets can be prepared with rapidly solidified strips of only three components. Component proportioning of magnet can also be directly performed by using mixed rare earth, so that the cost increased by further separation and purification of the rare earth is reduced. During the preparation of magnetic powder with a jet mill, an antioxidant lubricant which is composed of alcohol, gasoline and basic synthetic oil is added. A low-temperature sintering technology is adopted; and the sintering temperature is 1,010-1,050° C. and the annealing temperature is 450-550° C. The magnetic energy product $(BH)_m$ is more than 40 MGOe; and the coercive force $H_{cj}$ is more than 10 kOe. The production time and the energy loss can be significantly reduced.

3 Claims, 2 Drawing Sheets

| Elemnet | Line | Error | Cnts/s | Atomic% |
|---|---|---|---|---|
| Fe | Ka | 0.468 | 447.23 | 85.77 |
| Nd | La | 0.419 | 102.69 | 14.23 |
| Total | 100.0 | | | |

| Elemnet | Line | Error | Cnts/s | Atomic% |
|---|---|---|---|---|
| Fe | Ka | 0.504 | 420.08 | 87.40 |
| Ce | La | 0.229 | 31.18 | 4.30 |
| La | La | 0.340 | 55.60 | 8.30 |
| Total | 100.00 | | | |

LOW-NEODYMIUM, NON-HEAVY-RARE-EARTH AND HIGH PERFORMANCE MAGNET

PRIORITY CLAIM

This application claims priority to and incorporates by reference Chinese Patent Application No. 201110421875.5 filed Dec. 15, 2011.

TECHNICAL FIELD

This invention relates to the technical field of rare earth permanent magnetic materials, in particular, a kind of low-neodymium, non-heavy-rare-earth and high-performance magnet and its preparation method.

BACKGROUND OF THIS INVENTION

As the third generation of rare earth permanent magnet materials, Nd—Fe—B features high residual magnetism $B_r$, high coercive force $H_{cj}$ and high magnetic energy product $(BH)_m$. What's more, it does not contain the strategic element Co. So, it makes market immediately once such features are discovered, and becomes one of the key materials for modern science and technology development, like computer, IT, aerospace engineering, communication, transportation, office automation, household appliance and healthcare.

Compared with the second generation of SmCo magnet, Nd—Fe—B magnet has relatively great cost advantage. But its cost is still higher compare with ferrite magnet, wherein metal Nd takes 90% or above of the costs of the raw materials. With the constant growth of rare earth magnet yield all over the world, the utilization amount of metal Nd increases greatly, imposing great pressure on magnetic material manufacturers and users. To solve the problem, we invented this low-neodymium and high-performance magnet containing no heavy rare earth element and its preparation method, which has great practical meaning.

Beside Nd, metal elements of La and Ce within the natural rare earth resources features rich reserve and low cost. But, the magnetic torque Js and anisotropic field $H_A$ of $La_2Fe_{14}B$/$Ce_2Fe_{14}B$ falls far below that of $Nd_2Fe_{14}B$ and it is impossible to meet user's requirements on product performance when they are applied solely. In research work for substituting Nd partially by Ce, the Central Steel & Iron Research Institute under Ministry of Metallurgical Industry and Magnequench (Tianjin) Co., Ltd. respectively filed Chinese patents applications, Publication numbers CN1035737A and CN101694797. According to the method stated in the above patents/applications, the alloys containing multiple kinds of compositions need to be smelted for manufacturing different series and grades of magnets and the production costs are increased greatly. Besides, the residual magnetism, coercive force and magnetic energy product of the magnet prepared as the above patents/applications methods are relatively low. The reason is that Ce is smelted directly into the alloy, which leads to the Nd in the main phase dominantly substituted by Ce and worsens the properties of the magnets produced. In addition, For the preparation processing, as the sintering temperature of the magnet is above 1060° C., the grain size will grow large easily. As a result, the magnetic performance will be worsened and the magnet production costs will be increased.

DISCLOSURE OF THIS INVENTION

The aim of the present invention is to provide a kind of low-neodymium, no heavy rare earth element and high-performance magnet and its preparation method. 10%~40% of the total content Nd of the rare earth elements in the magnet is substituted by La, Ce (single one of the rare earth elements, or the combination of the two elements). At the same time, a small amount of metal element TM is added to improve the coercive force of the magnet. The properties of the series of magnets of the present invention will reach: magnetic energy product $(BH)_m$: 40 MGOe or above and coercive force $H_{cj}$ over 10 kOe. The production costs of the magnets are reduced greatly and the high magnetism properties of the magnet are maintained simultaneously. The magnets produced by this invention method can meet the use requirements of the magnets with equivalent properties on the market.

The magnet composition of this invention is $[(Nd, Pr)_{100-x}(Ce_{100-y}La_y)_x]_aFe_{100-a-b-c}B_bTM_c$ (wt. %), where x, y, a, b and c represent respectively the mass percent of the corresponding elements and $10\% \le x \le 40\%$, $0\% \le y \le 15\%$, $29\% \le a \le 30\%$, $0.8\% \le b \le 1.5\%$ and $0.5\% \le c \le 2\%$. TM is one or more of Ga, Co, Cu, Nb, and Al.

The method in this invention to prepare the above-mentioned magnet contains the following processing steps:

Step 1: prepare the raw materials respectively as the nominal composition of Nd—Fe—B alloy in mass percent: $[Nd_{100-x}(Ce_{100-y}La_y)x]_aFe_{100-a-b-c}B_bTM_c$ (wt. %) and $(Nd, Pr)_aFe_{100-a-b-c}B_bTM_c$ (wt. %), where, $10\% \le x \le 40\%$, $0\% \le y \le 15\%$, $29\% \le a \le 30\%$, $0.8\% \le b \le 1.5\%$, and $0.5\% \le c \le 2\%$. TM is one or more selected from Ga, Co, Cu, Nb and Al. The rare earth elements required can directly use the mixed rare earth elements with definite ratio of components;

Step 2: smelt the raw materials respectively formulated in Step 1 as follow: first of all, put the raw materials into the crucible pot of an intermediate-frequency induction smelting rapidly solidified furnace, switch on the power to preheat them when the vacuum reaches $10^{-2}$ Pa or above, stop the vacuum-pumping when the vacuum degree reaches $10^{-2}$ Pa or above again, inject the highly pure Ar to make Ar pressure inside the furnace reach −0.04~−0.08 MPa, and smelt then; conduct the electromagnetic stirring for purification after the raw materials smelt completely, then pour the molten steel onto the water-cooled copper rollers with a linear speed of 2~4 m/s, to get the rapid solidified strips with an uniform thickness of 0.1~0.5 mm;

Step 3: conduct hydrogen crash for the rapid solidified strips that obtained from Step 2 and get the coarse crashed magnetic powder after dehydrogenization. Mix the anti-oxidation lubricant and the coarse crashed magnetic powder at a proportion of 3~7 ml/kg under protective atmosphere, to prevent fine particles of the powders from conglobation and oxidation in the following jet mill processing. The rotating speed of the pneumatic concentration wheel in the jet mill processing shall be controlled at 3000 r/min~4000 r/min, with a view to guarantee that the particle sizes of two kinds of magnetic powders are approximate. The particle sizes of the magnetic powders shall be controlled at 1~6 μm;

Step 4: according to required components of different grades of magnets, weigh respectively the two kinds of magnetic powders prepared in Step 3 at different proportions, and mix them in a mixer;

Step 5: under protective atmosphere of the inert gases, conduct the aligned forming for the mixed magnetic powders in a magnetic field of 1.5~2.3 T, then conduct the cool isostatic compression processing to obtain green bodies;

Step 6: Put the green bodies prepared in Step 5 into a high vacuumed sintering furnace for sintering; heat for 0.5~10 h at 400° C.~800° C. for dehydrogenization during the sintering process; water cooling or air cooling after sinter for 1~4 h at 1000~1050° C., and conduct a tempering treatment for 1~4 h at 750~950° C. and 450~600° C., respectively.

For the anti-oxidation lubricant use in this invention, gasoline-alcohol takes 85%-96%, and basic synthetic oil takes 4%-15%. The anti-oxidation lubricant with different ratios will be prepared according to different types of the magnetic powders. The said alcohol may be ethanol or methanol. The viscosity index of the basic synthetic oil used is over 90, such as poly-α-alkene or ester oil, which has features of excellent thermal oxidation stability, low volatility, low or zero sulfur and low viscosity.

Compared to the prior arts, present invention has four advantages: first of all, the mixed rare earth elements are used to avoid the waste caused by further separation of the rare earth elements; a series of magnets can be prepared from only two kinds of quick solidified strips that are smelted, which has high flexibility of components adjustment; the low-temperature sintering and low-temperature tempering used will reduce the production time and energy consumption; in this invention, La and Ce may be used to substitute Nd at maximum possibility. The magnetic energy product $(BH)_m$ of the magnet prepared by the invented method is 40 MGOe or above and the coercive force $H_{cj}$ is 10 kOe or above, which greatly improves the price/performance ratio of magnets. This preparation technology is suitable to large-scale engineering production.

DETAILED DESCRIPTION OF THE EMBODIMENT MODES

Figure 1:
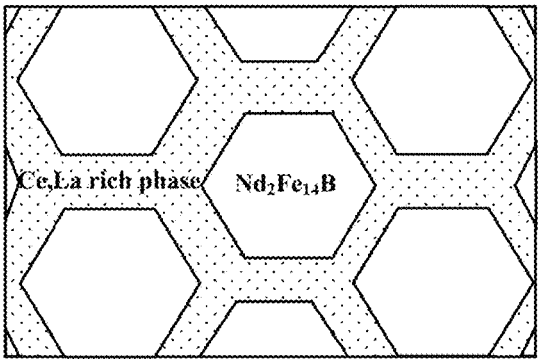
FIG. 1 shows a schematic drawing of the microstructure of the magnet prepared by present invention. Ce, La (single one of them, or the combination of them) distribute mainly in the grain-boundary phase. $Nd_2Fe_{14}B$ still maintains a higher volume fraction in the main phase.
Figure 2:
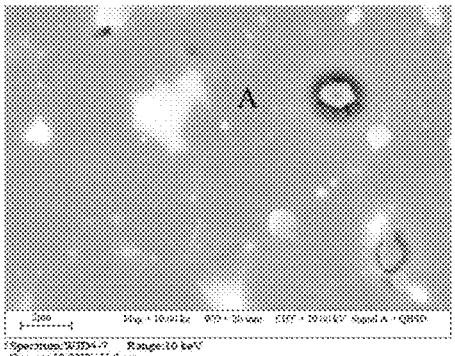
FIG. 2 shows the main phase energy spectrum drawing of magnet in embodiment 3 of present invention.
Figure 2:
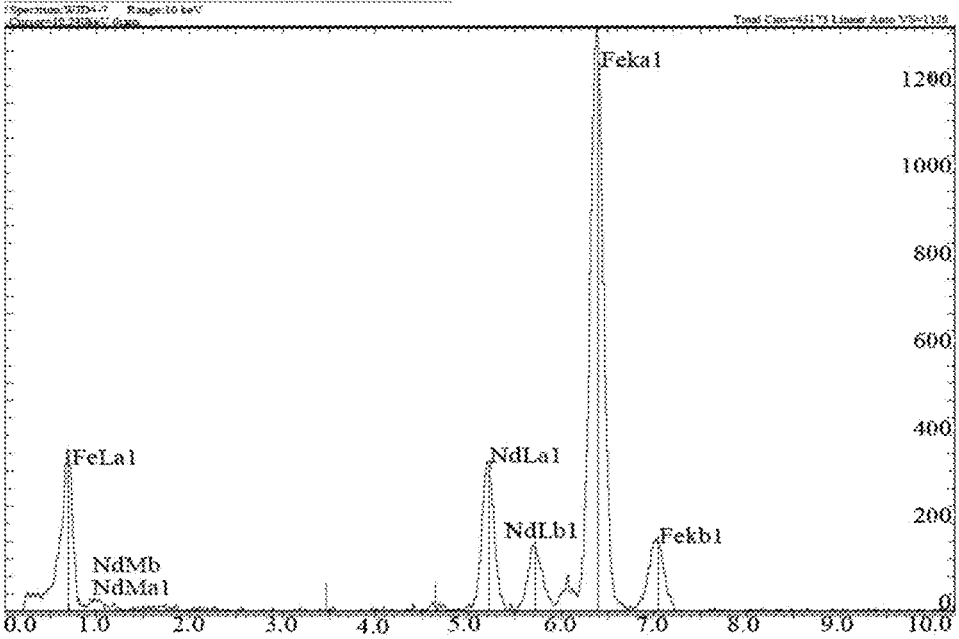
Figure 3:
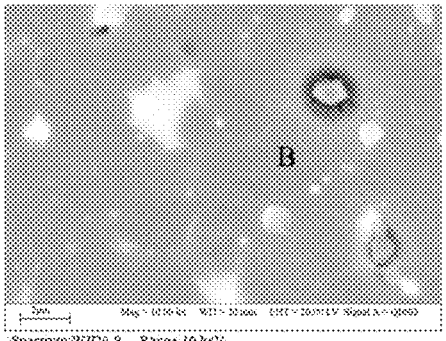
FIG. 3 shows the main phase energy spectrum drawing of magnet in embodiment 3 of present invention.
Figure 3:
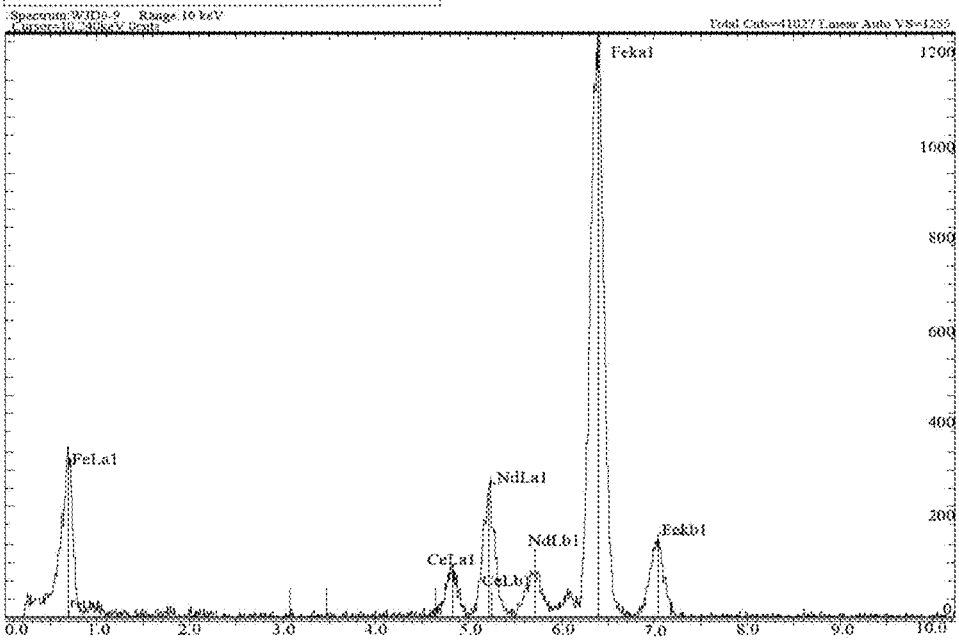

Below are detailed descriptions of the embodiments based upon the technical solution of this invention, which are helpful to better understand of this invention. But, it is worthy of mentioning that the embodiments below are provided for the sole purpose of explanation only, and the protection scope of this invention is not limited to the embodiments below.

Embodiment 1

As designed component $(Nd_{90}Ce_{10})_{30}Fe_{bal}\ B_{0.94}TM_{0.67}$ (TM=Ga, Co, Cu, Nb), wherein 10% Nd is substituted by Ce.

Step 1: prepare the raw materials respectively as the nominal composition of Nd—Fe—B alloy in mass percent: $(Nd_{70}Ce_{30})_{30}Fe_{bal}\ B_{0.94}TM_{0.67}$ (TM=Ga, Co, Cu, Nb) and $Nd_{30}Fe_{bal}B_{0.94}\ TM_{0.67}$ (TM=Ga, Co, Cu, Nb);

Step 2: smelt respectively the prepared raw materials with two different compositions. First of all, put the raw materials into the crucible pot of an intermediate-frequency induction smelting rapid solidified furnace, switch on the power to preheat them when the vacuum reaches $10^{-2}$ Pa or above, stop the vacuum-pumping when the vacuum reaches $10^{-2}$ Pa or above again, inject the highly pure Ar to make Ar pressure inside the furnace reach −0.06 MPa, and then smelt; conduct the electromagnetic stirring for purification after the raw materials smelt completely, finally, pour the molten steel onto the water-cooled copper rollers with a linear speed of 3 m/s, to get the rapidly solidified strips with a uniform thickness of 0.3 mm;

Step 3: put the obtained two kinds of rapidly solidified strips into hydrogenation furnace respectively to conduct coarse crash; mix the anti-oxidation lubricant and the coarse crashed magnetic-particles at a proportion of 5 ml/kg under the protective atmospheres. The gasoline-alcohol in the anti-oxidation lubricant takes 90% and eighteen alkyl acid ester of glycerol takes 10%; then conduct jet milling respectively, the rotating speed of the pneumatic concentration wheel in the following jet milling process is controlled at 3100 r/min, with a view to guarantee that the particle sizes of two kinds of magnetic powders are approximate. The uniform particle sizes of the magnetic-particles shall be approximately 3 μm;

Step 4: mix the two kinds of magnetic powders prepared in Step 3 as the designed composition requirements, wherein the amount of the magnetic powders with the nominal composition of $(Nd_{70}Ce_{30})_{30}Fe_{bal}\ B_{0.94}TM_{0.67}$ (TM=Ga, Co, Cu, and Nb) will be ⅓ of the total amount of the two kinds of magnetic powders; mix the two kinds of magnetic powders sufficiently in a mixer;

Step 5: under the protective atmosphere of inert gases, conduct the aligned forming for the mixed magnetic powders in a magnetic field with an intensity of 2 T, then conduct the cool isostatic compression processing to obtain green body;

Step 6: put the formed green bodies into a high vacuum sintering furnace; heat for 1 h at temperature of 400° C., 600° C. and 800° C. for dehydrogenization; water cooling after sintering for 2 h at 1020° C., and conduct the tempering treatment for 2 h at 900° C. and 520° C., respectively.

NIM-2000HF rare earth permanent magnet measuring device is adopted to measure the magnetic properties of the magnets. The measured properties are shown in Table 1 below.

TABLE 1

| Nominal composition | $B_r$/kGs | $H_{cj}$/kOe | $(BH)_m$/MGOe |
|---|---|---|---|
| $(Nd_{90}Ce_{10})_{30}Fe_{bal}B_{0.94}TM_{0.67}$ (Ga, Co, Cu, Nb) | 13.95 | 12.19 | 46.63 |

Embodiment 2

As designed composition $(Nd_{85}Ce_{15})_{30}Fe_{bal}B_{0.94}TM_{0.67}$ (TM=Ga, Co, Cu, and Nb), 15% Nd is substituted by Ce.

Step 1: prepare the raw materials respectively as the nominal composition of Nd—Fe—B alloy in mass percent: $(Nd_{70}Ce_{30})_{30}Fe_{bal}B_{0.94}TM_{0.67}$ (TM=Ga, Co, Cu, and Nb) and $Nd_{30}Fe_{bal}B_{0.94}\ TM_{0.67}$ (TM=Ga, Co, Cu, and Nb);

Step 2: smelt respectively the raw materials. First of all, put the raw materials into the crucible pot of an intermediate-frequency induction smelting rapid solidified furnace, switch on the power to preheat them when the vacuum reaches $10^{-2}$ Pa or above, stop the vacuum-pumping when the vacuum reaches $10^{-2}$ Pa or above again, inject the highly pure Ar to make Ar pressure inside the furnace reach −0.06 MPa, and then smelt; conduct the electromagnetic stirring for purification after the raw materials smelt completely, then pour the molten steel onto the water-cooled copper rollers with a linear speed of 3 m/s, to get the rapid solidified strips with a uniform thickness of 0.3 mm;

Step 3: conduct hydrogen crash for the two kinds of rapid solidified strips obtained and get the coarse crashed magnetic powder after dehydrogenization; mix the anti-oxidation lubricant and the coarse decrepitated magnetic powders at a proportion of 5 ml/kg under an protective atmosphere, wherein the gasoline-methanol in the anti-oxidation lubricant takes 90% and eighteen alkyl acid ester of glycerol takes 10%. In the following jet milling process conducted for them respectively, the rotating speed of the pneumatic concentration wheel in the jet mill processing is controlled at 3100 r/min, with a view to guarantee that the particle sizes of two kinds of magnetic powders are approximate. The particle sizes of the magnetic powders prepared shall be approximately 3 μm;

Step 4: mix the two kinds of magnetic powders prepared in Step 3 as the design composition required, and the amount of the magnetic powder with the nominal composition of $(Nd_{70}Ce_{30})_{30}Fe_{bal}$ $B_{0.94}TM_{0.67}$ (TM=Ga, Co, Cu, and Nb) will be ½ of the total amount of the two kinds of magnetic powders; mix the two kinds of magnetic powders sufficiently in a mixer;

Step 5: under the protective atmosphere of inert gases, conduct the aligned forming for the mixed magnetic powders in a magnetic field with an intensity of 2 T, then conduct the cool isostatic compression processing to obtain green body;

Step 6: put the green bodies prepared in Step 5 into the sintering furnace with a high vacuum for sintering; heat for 1 h at 400° C., 600° C. and 800° C. for dehydrogenization during the sintering process; water cooling shall be conducted after sintering for 2 h at 1020° C., and conduct the tempering treatment for 2 h at 900° C. and 520° C., respectively;

NIM-2000HF rare earth permanent magnet measuring device is adopted to measure the magnetic properties of the magnets. The measured properties are shown in the Table 2 below.

TABLE 2

| Nominal composition | $B_r$/kGs | $H_{cj}$/kOe | $(BH)_m$/MGOe |
|---|---|---|---|
| $(Nd_{85}Ce_{15})_{30}Fe_{bal}B_{0.94}TM_{0.67}$ (TM = Ga, Co, Cu, Nb) | 13.76 | 11.39 | 45.58 |

Embodiment 3

As the designed composition $(Nd_{80}Ce_{20})_{30}Fe_{bal}$ $B_{0.94}TM_{0.67}$ (TM=Ga, Co, Cu, and Nb), 20% Nd is substituted by Ce.

Step 1: prepare the raw materials respectively as the nominal composition of $(Nd_{70}Ce_{30})_{30}Fe_{bal}$ $B_{0.94}TM_{0.67}$ (TM=Ga, Co, Cu, Nb) and $Nd_{30}Fe_{bal}B_{0.94}$ $TM_{0.67}$ (TM=Ga, Co, Cu, and Nb);

Step 2: smelt respectively the raw materials. First of all, put the raw materials into the crucible pot of an intermediate-frequency induction smelting rapid solidified furnace, switch on the power to preheat them when the vacuum reaches $10^{-2}$ Pa or above, stop the vacuum-pumping when the vacuum reaches $10^{-2}$ Pa or above again, inject the highly pure Ar to make Ar pressure inside the furnace reach −0.06 MPa, and smelt then; conduct the electromagnetic stirring for purification after the raw materials smelt completely, then pour the molten steel onto the water-cooled copper rollers with a linear speed of 3 m/s, to obtained the rapid solidified strips with a uniform thickness of 0.3 mm;

Step 3: conduct hydrogen crash for the two kinds of rapid solidified strips obtained and get the coarse crashed magnetic powders after dehydrogenization; mix the anti-oxidation lubricant and the coarse crashed magnetic powders at a proportion of 5 ml/kg under the protective atmosphere. The gasoline-methanol in the anti-oxidation lubricant takes 90% and eighteen alkyl acid ester of glycerol takes 10%. In the following jet milling process conducted for them respectively, the rotating speed of the pneumatic concentration wheel shall be controlled at 3100 r/min, with a view to guarantee that the particle sizes of two kinds of magnetic powders are approximate. The particle sizes of the magnetic powders prepared shall be approximately 3 μm;

Step 4: mix the two kinds of magnetic powder prepared in Step 3 as the designed composition required, and the amount of the magnetic powders with the nominal composition of $(Nd_{70}Ce_{30})_{30}Fe_{bal}$ $B_{0.94}TM_{0.67}$ (TM=Ga, Co, Cu, and Nb) account for ⅔ of the total amount of the two kinds of magnetic powders; mix the two kinds of magnetic powers sufficiently in a mixer;

Step 5: under the protective atmosphere of inert gases, conduct the aligned forming for the mixed magnetic powders in a magnetic field with an intensity of 2 T, then conduct the cool isostatic compression processing to obtain green body;

Step 6: put the green bodies prepared in Step 5 into the sintering furnace with a high vacuum for sintering; heat for 1 h at 400° C., 600° C. and 800° C. for dehydrogenization during the sintering process; water cooling shall be conducted after sintering for 2 h at 1020° C., and conduct the tempering treatment for 2 h respectively at 900° C. and 520° C.;

NIM-2000HF rare earth permanent magnet measuring device is adopted to measure the magnetic properties of the magnets. The measured properties are shown in the Table 3 below.

TABLE 3

| Nominal composition | $B_r$/kGs | $H_{cj}$/kOe | $(BH)_m$/MGOe |
|---|---|---|---|
| $(Nd_{80}Ce_{20})_{30}Fe_{bal}B_{0.94}TM_{0.67}$ (TM = Ga, Co, Cu, Nb) | 13.61 | 11.12 | 44.31 |

We claim:

1. A low-neodymium, non-heavy rare earth elements and high-performance magnet having two magnetic main phases and a chemical formula of $[(Nd, Pr)_{100-x}$ $(Ce_{100-y}La_y)_x]_a$ $Fe_{100-a-b-c}B_bTM_c$, wherein, x, y, a, b and c represent respectively a mass percent of the corresponding elements, $10 \le x \le 40$, $0 \le y \le 15$, $29 \le a \le 30$, $0.8 \le b \le 1.5$, $0.5 \le c \le 2$, and TM is one or more elements selected from the group consisting of Ga, Co, Cu, Nb and Al;

wherein the high-performance magnet is prepared from sintering two raw materials: $[Nd_{100-x1}(Ce_{100-y}La_y)x_1]_a$ $Fe_{100-a-b-c}B_bTM_c$ and $(Nd, Pr)_aFe_{100-a-b-c}B_bTM_c$, $10 \le x1 \le 40$ at 1,000~1,050° C. to obtain the high-performance magnet having a magnetic energy product (BH)m of more than 40 MGOe, and a coercive force Hcj of more than 10 kOe.

2. The low-neodymium, non-heavy rare earth elements and high-performance magnet of claim 1, prepared by method comprising:

(1) preparing the raw materials respectively according to a nominal composition of Nd—Fe—B alloy in mass percent: $[Nd_{100-x1}(Ce_{100-y}La_y)_{x1}]_aFe_{100-a-b-c}B_bTM_c$ and $(Nd, Pr)_aFe_{100-a-b-c}B_bTM_c$, wherein $10 \leq (x, x1) \leq 40$, $0 \leq y \leq 15$, $29 \leq a \leq 30$, $0.8 \leq b \leq 1.5$, $0.5 \leq c \leq 2$, and TM is one or more elements selected from the group consisting of Ga, Co, Cu, Nb and Al;

(2) smelting respectively the raw materials prepared in Step 1 comprising: placing one of the two raw materials into a furnace, preheating the raw material while vacuuming until the furnace reaches a vacuum of $10^{-2}$ Pa or above, introducing Ar after stopping the vacuuming to provide an Ar pressure inside the furnace to −0.04~0.08 MPa, smelting until the raw material smelt completely conducting an electromagnetic stirring for purification after the raw material smelts completely, and pouring the molten raw material onto a cooled roller with a linear speed of 2~4 m/s to obtain a rapid solidified strip with an uniform thickness of 0.1~0.5 mm;

(3) preparing powders of the raw materials respectively from the rapid solidified strip obtained from step 2 comprising: conducting a hydrogen crash to the rapid solidified strip obtained from Step 2 to obtain a coarse crashed magnetic powder after dehydrogenization, mixing the coarse crashed magnetic powder with an anti-oxidation lubricant at a proportion of 3~7 ml/kg by the weight of the powder under a protective atmosphere to provide a first mixture, processing the first mixture in a jet mill process at a rotating speed of a pneumatic concentration wheel of 3,000 r/min~4,000 r/min to obtain particles of the raw material with particle sizes in the range of 1~6 μm;

(4) mixing the powders of the two raw materials prepared in Step 3 at a desired proportion to provide mixed magnetic powders;

(5) under a protective atmosphere of inert gases, conducting an aligned forming for the mixed magnetic powders in a magnetic field of 1.5~2.3 T, then conducting a cool isostatic compression processing to obtain green bodies; and (6) putting the green bodies after oriented forming and cool isostatic compression processing into the sintering furnace with a high vacuum for sintering heating for 0.5~10 h at 400° C.~800° C. for dehydrogenization during a sintering process; cooling after heating for 1~4 h at a sintering temperature of 1,000~1,050° C., and conducting a tempering treatment for 1~4 h at 750~950° C. and 450~600° C., respectively.

3. The low-neodymium, non-heavy rare earth elements and high-performance magnet of claim 2, wherein the anti-oxidation lubricant comprises 85%-96% gasoline-alcohol and 4%-15% basic synthetic oil, wherein a viscosity index of the basic synthetic oil is more than 90, the alcohol is ethanol or methanol, and the basic synthetic oil is a poly-a-alkene or an ester oil.

* * * * *